US011426666B2

(12) United States Patent
Glasenhardt et al.

(10) Patent No.: US 11,426,666 B2
(45) **Date of Patent: *Aug. 30, 2022**

(54) TOY AND PLAY SYSTEM

(71) Applicant: Big Monster Toys LLC, Chicago, IL (US)

(72) Inventors: George Glasenhardt, Chicago, IL (US); Brian Kujawski, Crown Point, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/360,109

(22) Filed: Jun. 28, 2021

(65) Prior Publication Data

US 2021/0322890 A1 Oct. 21, 2021

Related U.S. Application Data

(63) Continuation of application No. 16/834,157, filed on Mar. 30, 2020, now Pat. No. 11,077,379.

(51) Int. Cl.
*A63H 3/52* (2022.01)
*A63H 33/00* (2006.01)

(52) U.S. Cl.
CPC ..... *A63H 3/52* (2013.01); *A63H 33/003* (2013.01)

(58) Field of Classification Search
CPC ..... A63H 3/52; A63H 33/033; A63H 33/42; A63H 33/003; A47B 3/10; A47C 4/52
See application file for complete search history.

(56) References Cited

U.S. PATENT DOCUMENTS

| | | | | |
|---|---|---|---|---|
| 3,532,378 | A | 10/1970 | Dalia | |
| 4,516,948 | A | 5/1985 | Obara | |
| 4,875,681 | A | 10/1989 | Ofir | |
| 5,004,445 | A | 4/1991 | Coleman | |
| 5,013,278 | A | 5/1991 | Dixon | |
| 5,152,710 | A | 10/1992 | Montgomery | |
| 5,250,000 | A | 10/1993 | Boutin | |
| 5,643,038 | A | 7/1997 | Olsen | |
| 5,971,833 | A | 10/1999 | Rasmussen | |
| 6,572,436 | B1 | 6/2003 | So | |
| 7,785,168 | B2 | 8/2010 | Yamada | |
| 11,077,379 | B1 * | 8/2021 | Glasenhardt | A63H 3/52 |
| 2004/0188204 | A1 | 9/2004 | Wilkins-Langie | |
| 2006/0099874 | A1 | 5/2006 | Cartlidge | |

OTHER PUBLICATIONS www.amazon.com/Polly-Pocket-Cruise-Compact-Accessories, Polly Pocket World Sweet Sails Cruise Ship Compact, p. 1.
https://www.pinterest.pt/pin/638033472190712137/, 30th Anniversary Heritage Polly Pocket Compact, p. 1.

* cited by examiner

*Primary Examiner* — John A Ricci
(74) *Attorney, Agent, or Firm* — Aronberg Goldgehn Davis & Garmisa

(57) ABSTRACT

The present system relates to a toy and play system that provides 360-degree play surfaces along with extendable play areas. Multiple embodiments of the toys may be arranged proximal to one another to create an extended play environment. The toys may be manipulated from a closed orientation to an open orientation that provides for horizontal and vertical play while maintaining stability of the toy.

12 Claims, 10 Drawing Sheets

TOY AND PLAY SYSTEM

CROSS-REFERENCE

This is a continuation of, and claims priority to, U.S. patent application Ser. No. 16/834,157, filed on Mar. 30, 2020, the entirety of which is incorporated herein by this reference for all purposes.

BACKGROUND

There are a number of different compact style toys on the market. The toys feature the same general clamshell construction where the two sides of the toy hinge open. When opened, the top and bottom sides of the toy are generally oriented in an approximately 90-degree angled relationship where the top portion offers a vertical play area and the bottom offers a horizontal play area. The external back of the vertical portion and external bottom of the horizontal portion form the outside of the compact and are solid to form an enclosed structure.

The traditional design suffers from a number of drawbacks. For example, the majority of the top portion overhangs the perimeter of the bottom portion making the compact unstable. The solid back limits the play area to only internal portion of the compact. The compact is entirely self-contained such that multiple compacts do not interface with one another. Accordingly, there is a need for a compact toy that offers a more stable play environment, that provides dynamic features that utilize then entirety of the available play space, and that can interface with other similar compact toys to encourage expansion of the play area.

SUMMARY

The present toy and play system incorporate the foldable and openable compact style container with a 360-degree playing area that is adaptable for use with multiple embodiments of the toy and play system. An embodiment of the toy may include an outer shell formed from two pieces connected by a hinge. The hinge allows a top piece to open, fold around the backside of the bottom piece and form a substantially vertical play area that mates with the bottom piece. In one embodiment, the position of the hinge is such that a base portion of the top piece rests on a surface of the bottom piece such that the center of mass of the top piece is positioned over the bottom piece. That arrangement prevents the weight of the top piece (and particularly the weight of the top piece plus the weight of supplemental toy pieces added to play surfaces of the top piece) from creating a moment of force that tips the toy over.

The top piece may include a cavity having one or more play surfaces. The play surfaces may be oriented in the horizontal plane when the top piece is arranged vertically. In other embodiments, the surfaces may form ramps. When the top is folded open, the cavity may be exposed to allow access to the cavity. The top piece may include one or more movable segments, such as doors or windows. The moveable segments may be attached by one or more hinges, brackets, or slides such that the segments are movably attached to the main structure of the top. In one embodiment, the moveable segments are removable and may be reattached to the top piece in their original orientation or in an alternate orientation to form additional play areas through the use of frictional engagement (such as a peg and detent or resilient clip) or magnets.

The bottom piece may exhibit a bottom surface portion and a cavity. The cavity allows for portions of the interior of the top piece to extend beyond the terminal edge of the cavity of the top piece but still allow the compact to close securely. When in the open configuration, the terminal edge of the bottom cavity forms the base that rests on a surface (such as a table), and the bottom surface portion is positioned facing up to form a play surface.

The bottom may also include a movable panel. The moveable panel may be molded to form an additional play structure or have additional play structures attached to it. The movable panel may be connected to the bottom such that it may be manipulated into multiple orientations. For example, when the compact is closed, the movable panel may be in a first orientation such that the additional play structure is positioned within the bottom cavity. However, when the compact is opened (for example), the moveable panel may be manipulated to a second orientation such that the additional play structure is exposed and proximal to the play surface of the bottom.

In another embodiment, the bottom houses one or more extendable side panels. The side panels may be configured to slide in and out of the bottom. In one embodiment, the extendable side panels are linked to the moveable panel having the additional play structure. When the movable panel is in the first orientation within the bottom cavity, the extendable side panels are contained within the bottom. Manipulating the movable panel to the second position such that the additional play structure is expose causes one or more of the extendable side panels to extend out of the bottom so as to form an additional play surface. In one embodiment, the bottom houses two extendable side panels, each extending from an opposite side of the bottom. The extendable side panels may extend at substantially the same height from the terminal edge of the bottom cavity. That way, when two or more embodiments of the present toy are place proximal to one another with extendable side panels extended, the extendable side panels may align, and, in some embodiments, connect, to form a continuous path across the extendable side panels and bottom play surface portions of the embodiments of the present toy.

Additional embodiments and operations of the toy and paly system are discussed in further detail in connection with the figures.

DETAILED DESCRIPTION OF EMBODIMENTS

Figure 1:
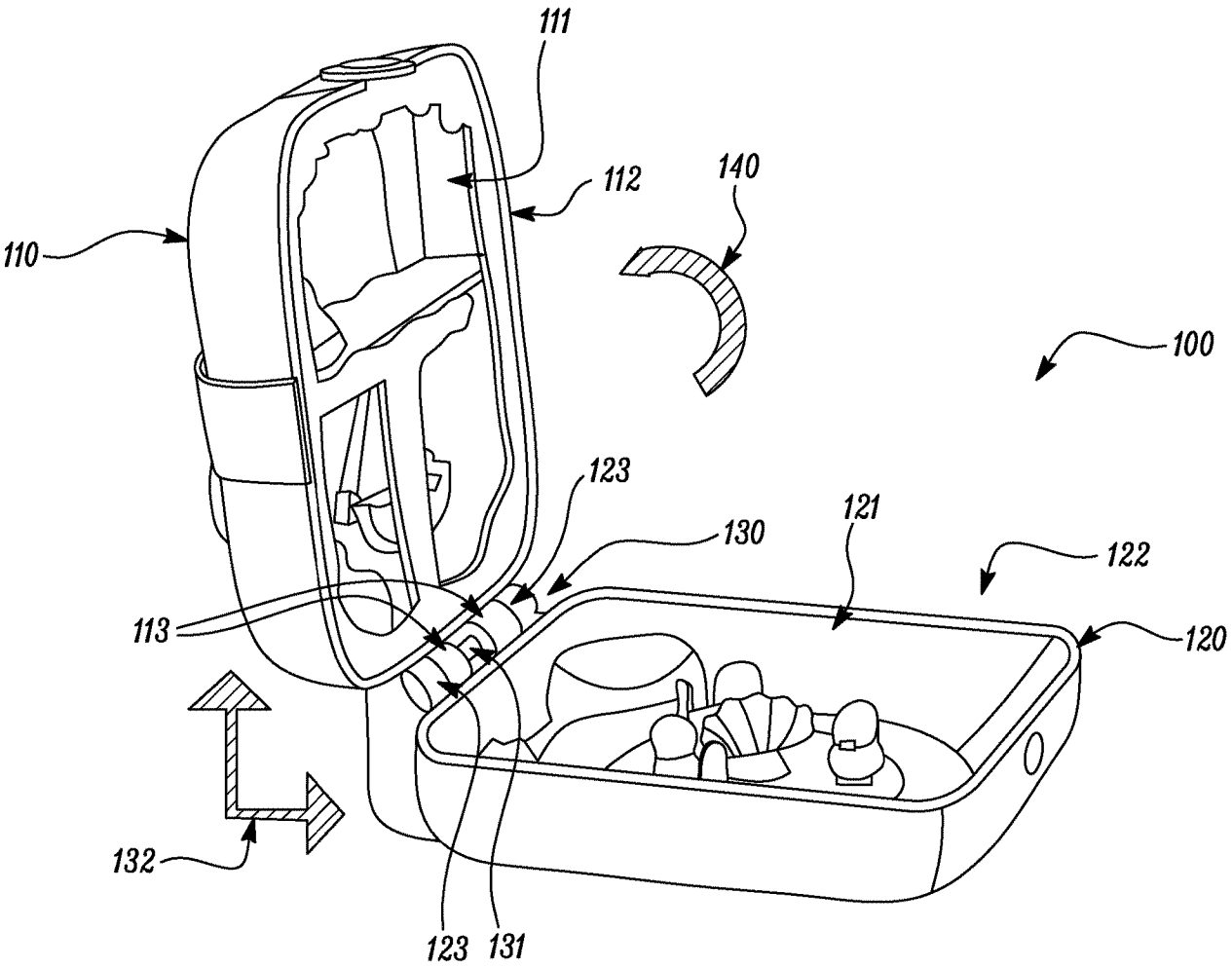
PRIOR ART FIG. 1
FIG. 1 is a depiction of a prior art structure.

Throughout the specification, wherever practicable, like structures will be identified by like reference numbers. In some figures, components, such as additional connectors or fasteners have been omitted for clarity in the drawings. Unless expressly stated otherwise, the term "or" means "either or both" such that "A or B" includes A alone, B alone, and both A and B together. While the present toy and play system may be manipulated and played with in any orientation, for ease of reference—and not by way of limitation—structures may be referred to as "top" or "bottom."

FIG. 1 is a depiction of a prior art compact 100. It includes a top 110 and a bottom 120. The top further includes a top cavity 111 that terminates at a top terminal edge 112. The bottom includes a bottom cavity 121 that terminates at a bottom terminal edge 122. The top 110 and bottom 120 are connected by a hinge 130. The hinge allows for the top and bottom to open and close. The hinge is formed by a plurality of protuberances 113 formed along one portion of the terminal edge 112 of the top 110, a plurality of protuberances 123 formed along one portion of the terminal edge 122 of the bottom 120, and a hinge pin 131.

When in the open position, the top and bottom form an approximately 90-degree angle at the hinge 130, as shown by arrow 132. The top is cantilevered out from the bottom such that the center of mass of the top is positioned outside of the perimeter of the bottom terminal edge 122. The position of the top creates a moment of inertia due to gravitational forces acting on the top such that the top tends to create rotational motion in the direction of arrow 140 that lifts the bottom up and away from a resting surface (such as a table, not shown).

Figure 2:
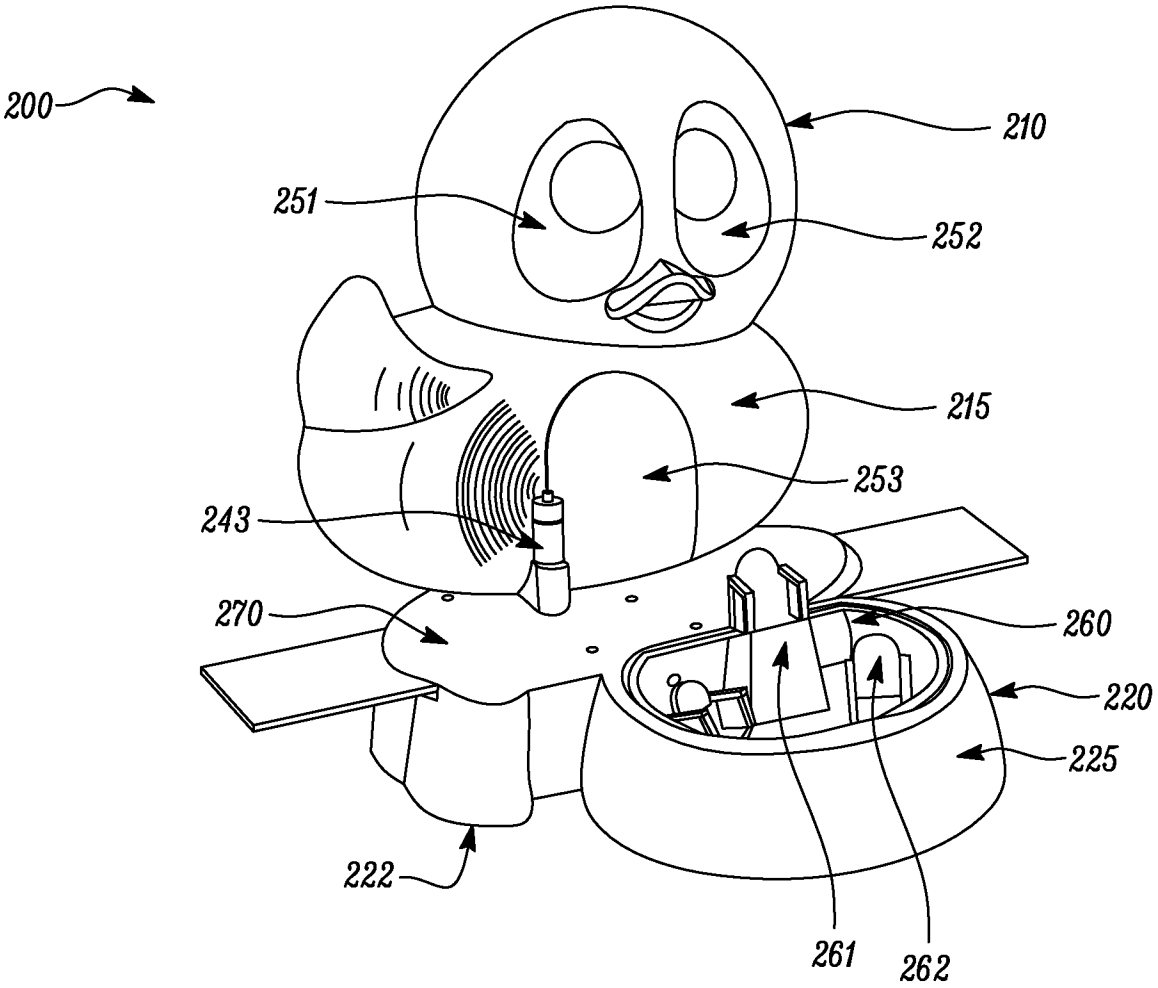
FIG. 2 is a front perspective view of an embodiment of the present toy and play system in an open configuration.
Figure 3:
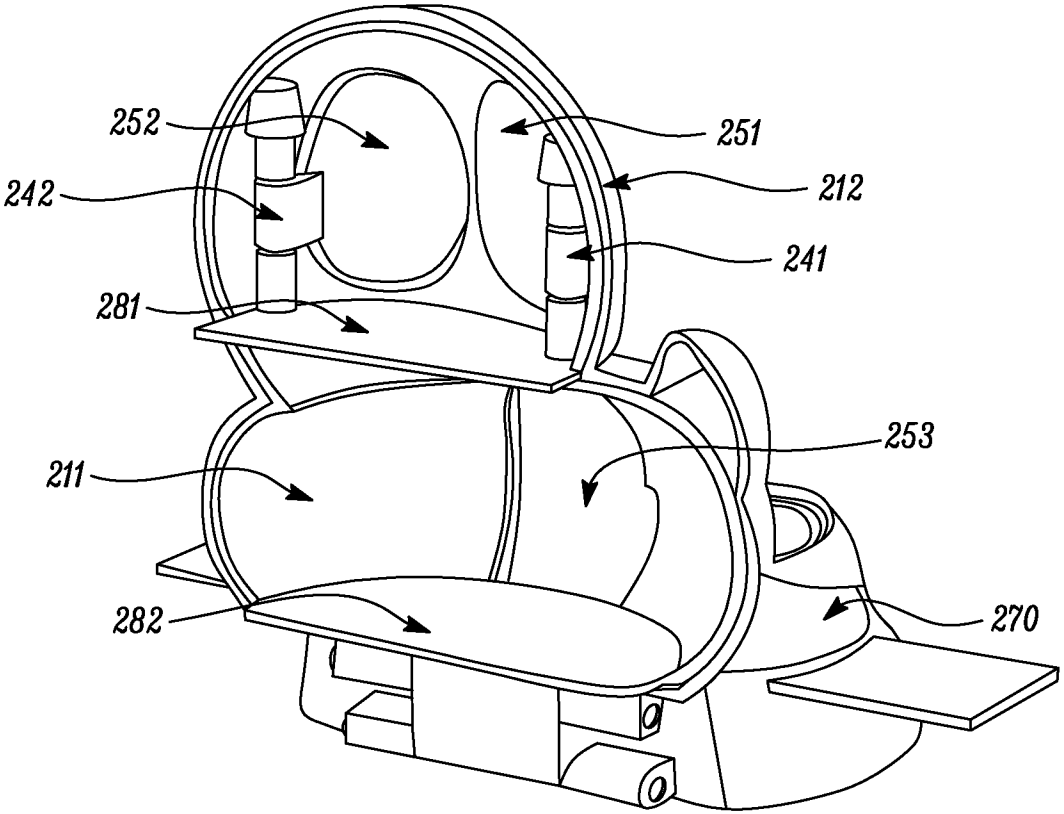
FIG. 3 is a rear perspective view of an embodiment of the present toy and play system in an open configuration.
Figure 10:
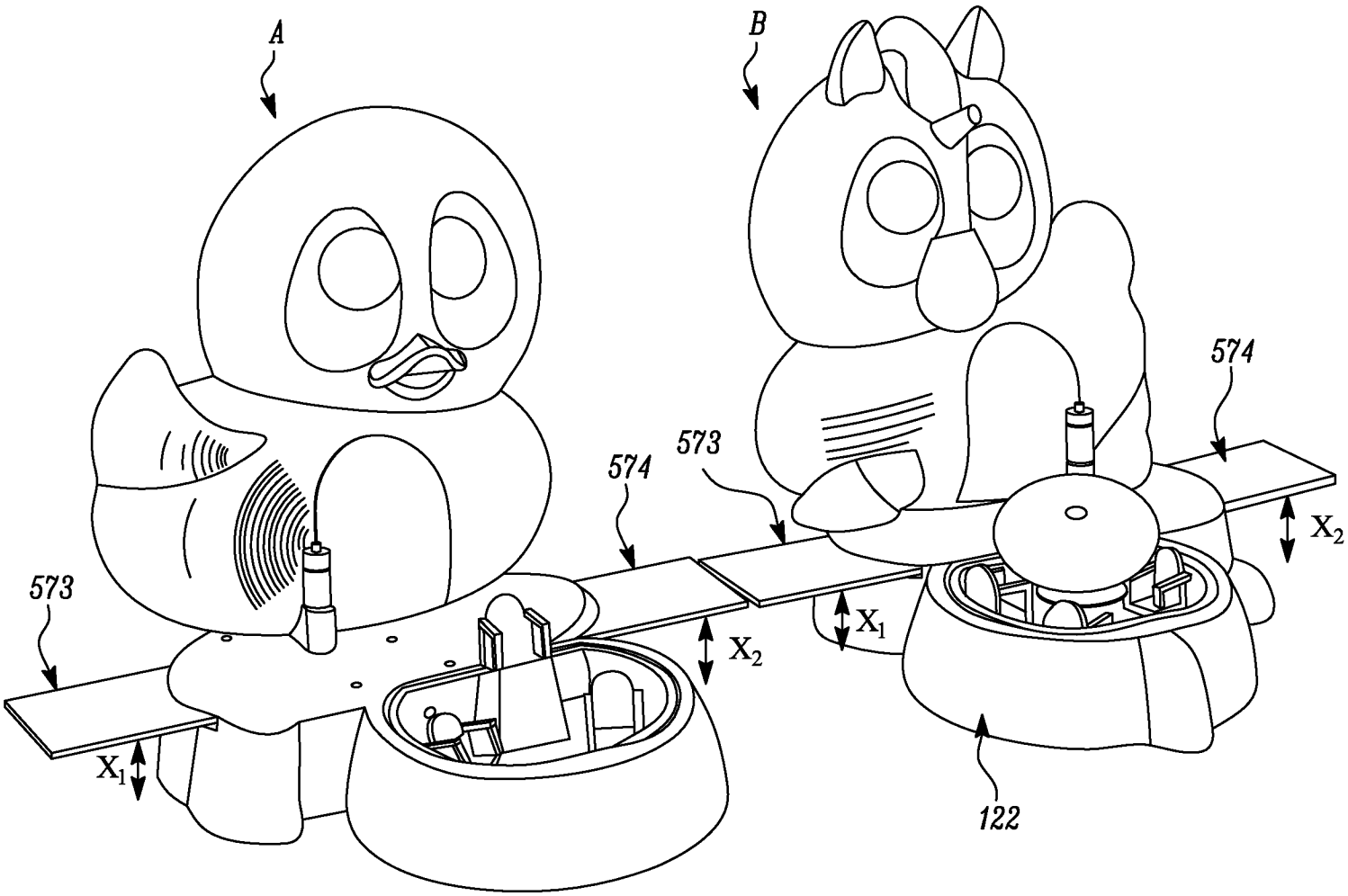
FIG. 10 is a perspective view of multiple embodiments of the present toy and play system in open configurations and arranged proximal to one another.

FIGS. 2 and 3 are depictions of one embodiment of the present toy and system which may be referred to generally as compact 200. It includes a top 210 and bottom 220. Some embodiments may be in the form of a character, such as a duck (embodiment A in FIG. 10) or unicorn (embodiment B in FIG. 10), though other embodiments may exhibit different shapes. The top 210 is formed of a top shell 215. The top shell 215 defines the outer surface of the top and terminates at the top terminal edge 212. The top may also include a top cavity 211. The top cavity is formed by the inside surface of the top and is bounded by the top terminal edge 212.

The top 210 may further include one or more segments 251, 252, 253. The segments may be movably attached to the top. For example, in the embodiment of FIGS. 2 and 3, segment 251 is attached to the top by hinge 241 such that the hinge allows for movement of the segment 251 with respect to the top 210 while the segment 251 remains attached to the top 210. Similarly, segment 252 is movably attached to the top by hinge 242, and segment 253 is movably attached to the top by hinge 243. It should be appreciated that alternative attachments to hinges could be utilized, such as groves or brackets in the top that allow the segment to slide with respect to the top.

The top 210 may further include one or more top play surfaces on the outside of top shell 215 or within the top cavity 211 such as top play surfaces 281, 282 shown in FIG. 3. The play surfaces may be integrated with the top shell, or may alternatively be attached to the top shell. In the embodiment of FIG. 3, the top play surfaces form flat, horizontal platforms when the top is oriented vertically with respect to the bottom (as shown in FIGS. 2 and 3). However, the top play surfaces may be contoured, such as to form stairs or a ladder or to include an integral structure, such as a chair, and may alternatively be slanted or sloped to form a ramp or slide. In one embodiment, the top play surface is slanted to form a ramp between a first top play surface 281 and a second top play surface 282.

Figure 4:
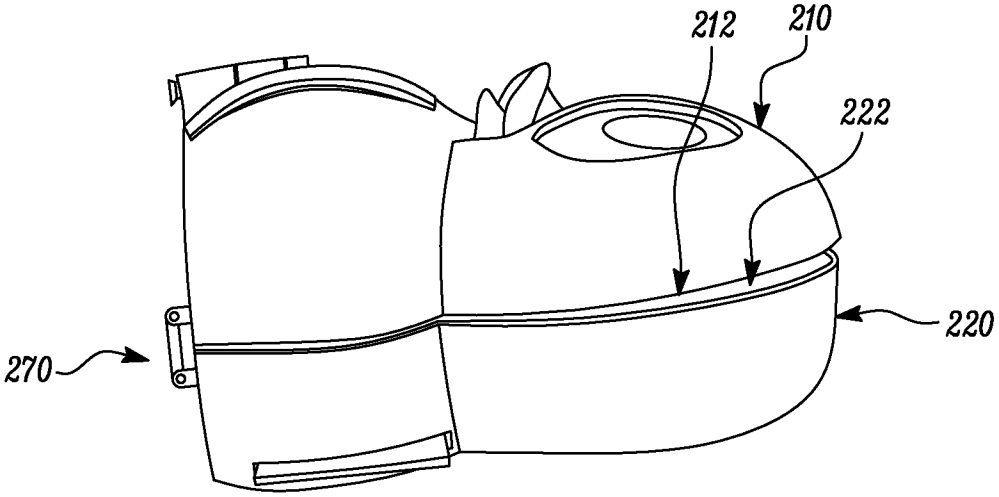
FIG. 4 is a side view of an embodiment of the present toy and play system in a closed configuration.
Figure 5:
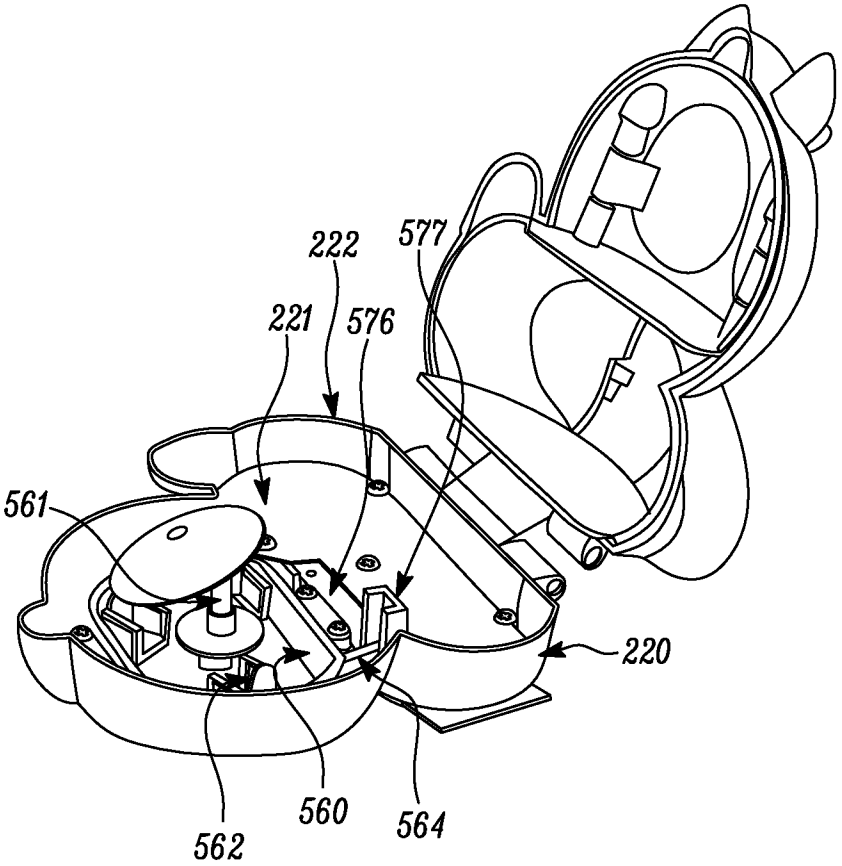
FIG. 5 is a perspective view of an embodiment of the present toy and play system in partially open state and depicting the internal cavities of the toy and play system.

The bottom 220 is formed of a bottom shell 225. The bottom shell 225 defines the outer surface of the bottom and terminates at the bottom terminal edge 222. The bottom shell may include a bottom surface 270, which may alternatively be referred to as the bottom play surface. The bottom surface 270, may be referred to as the "bottom" for reference purposes because, as shown in FIG. 4, when the top 210 and bottom 220 are in the closed position (such that the top terminal edge 212 and bottom terminal edge 222 are brought proximal to one another), and compact 200 is oriented in the horizontal position, the bottom surface 270 forms the bottom of the unit. However, when the top 210 and bottom 220 are in the open position, as shown in FIG. 2, the bottom surface 270 forms a bottom play surface. As shown in FIG. 5, the bottom may also include a bottom cavity 221. The bottom cavity is formed generally by the inside surface of the bottom and is bounded by the bottom terminal edge 222.

The bottom may further include one or more movable panels. For example, as shown in FIGS. 2 and 5, the bottom 220 includes movable panel 260 and 560, respectively. The movable panel may include additional play structures, such as structures 261, 262 in FIG. 2, or 561, 562, in FIG. 5, that may be affixed to or integrally formed with the movable panel. In one embodiment, the additional play structures are formed on an inside portion of the movable panel 260 and the exterior portion of the movable panel is shaped to match the contour of the bottom shell 225. For example, in the embodiment of FIGS. 6-7, the movable panel 560 includes external surface 563 that is substantially flat to match the flat contour of the bottom surface 570. Movable panel 560 further includes additional play structures 561 and 562 on the side opposite external surface 563.

Figure 7:
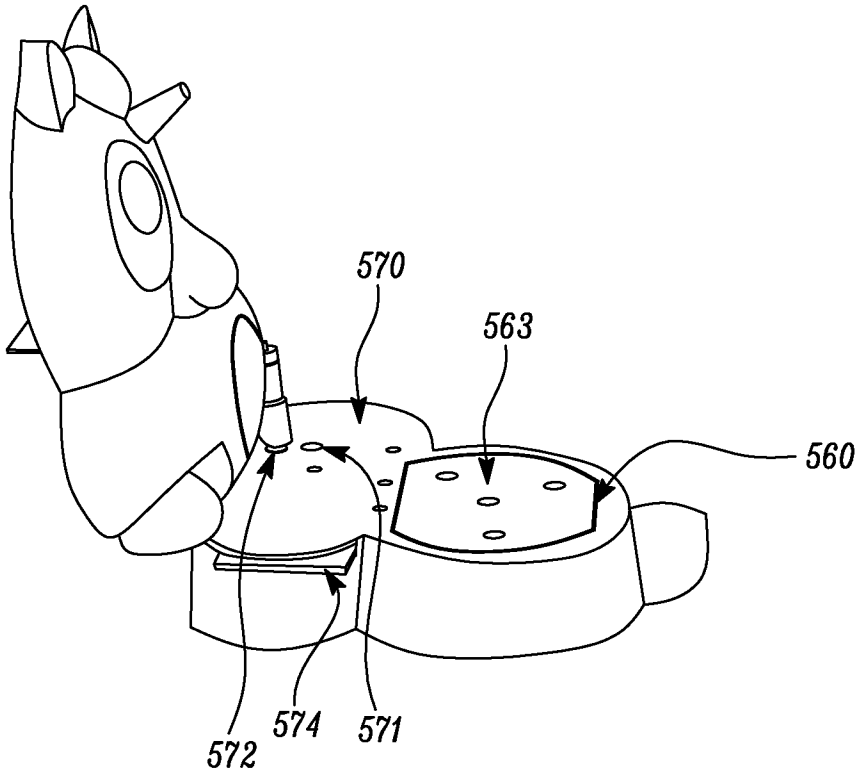
FIG. 7 is a side view of an embodiment of the present toy and play system in a partially open configuration.
Figure 8:
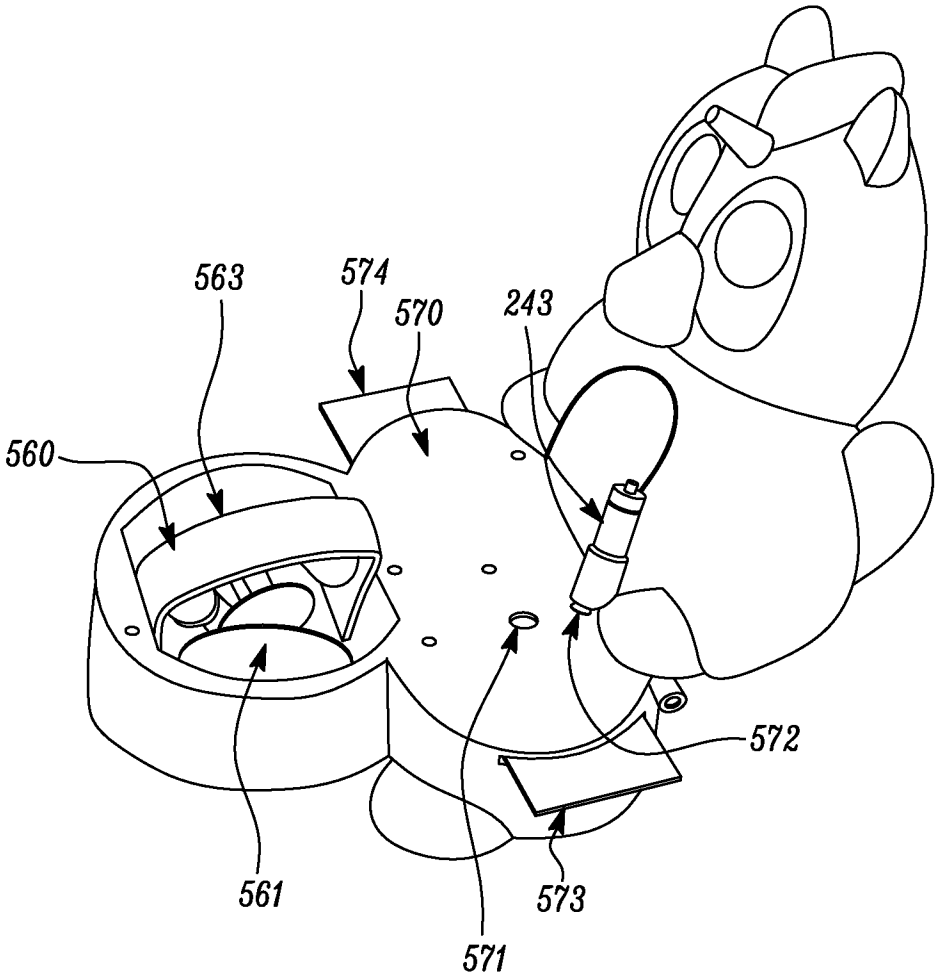
FIG. 8 is a side perspective view of an embodiment of the present toy and play system in partially open configuration and depicting a movable panel and a plurality of extendable side panels that are partially extended.
Figure 9:
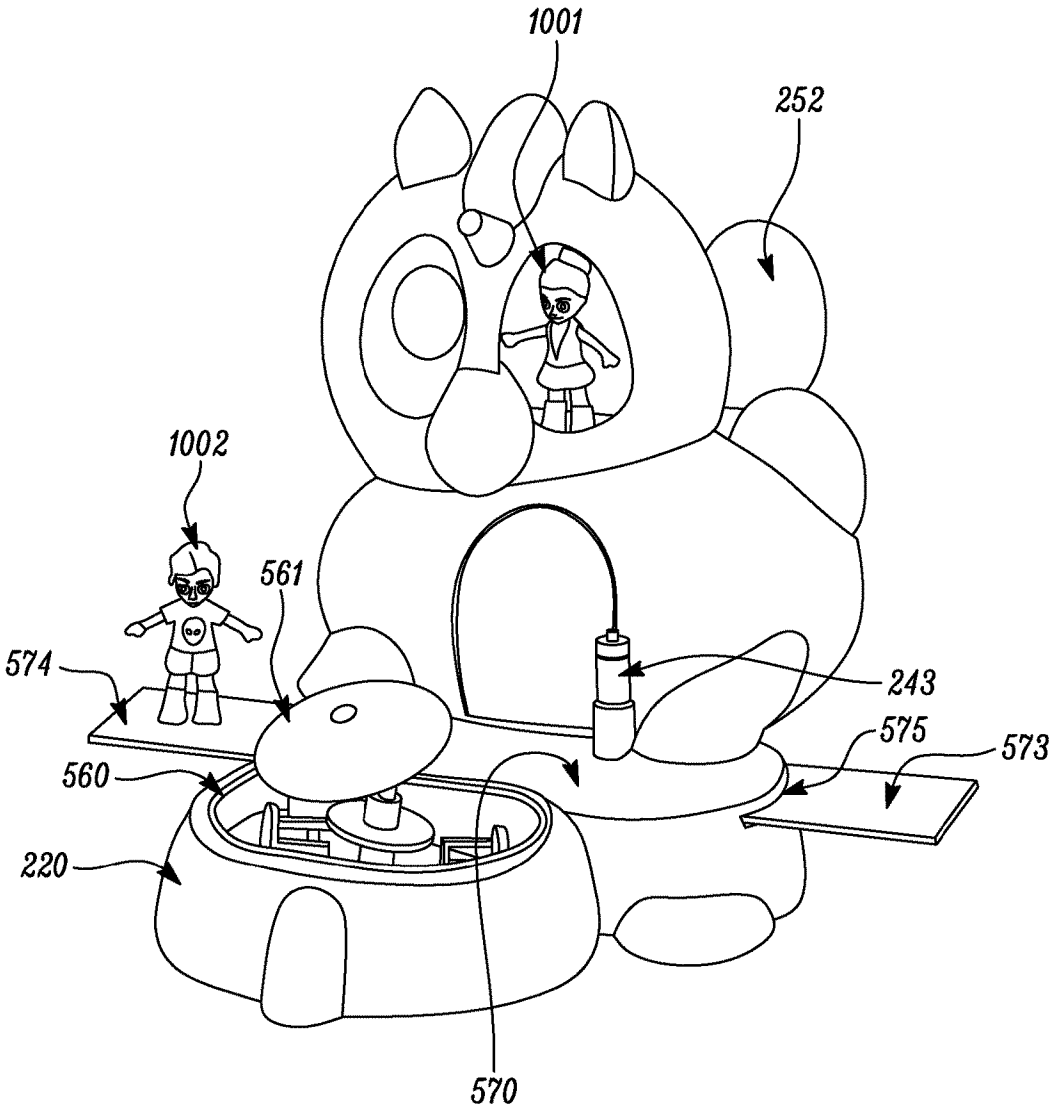
FIG. 9 is a front perspective view of an embodiment of the present toy and play system in an open configuration and depicting an open movable segment and extended extendable side panels.

As noted, the movable panel 560 is movable with respect to the bottom shell 225. In one embodiment, a plurality of pins (not shown) that are axially aligned are connected to the movable panel 560. The pins connect to the bottom shell such that movable panel 560 may rotate about the axially aligned pins as shown in FIGS. 7-9. In FIG. 7, the movable panel is in the closed position, where the additional play structures 561 and 562 are contained within cavity 221. In FIG. 8, the movable panel 560 is partially rotated about the axially aligned pins. In FIG. 9, the movable panel is fully rotated 180-degrees, such that additional play structures (such as 561) are exposed and arranged proximally to the bottom play surface 570.

In one embodiment, the bottom 220 further includes one or more extendable play surfaces, for example, with reference to FIGS. 8-9, extendable play surface 573 and extendable play surface 574. The extendable play surfaces may be housed (either covered or uncovered) within the cavity 221 of the bottom 220. When an extendable play surface is in a retracted state, as in FIG. 5, the majority of the extendable play surface is contained within the bottom cavity 221 and obscured by bottom play surface 570. When an extendable play surface is in an extended orientation, as in FIG. 9, a majority of the extendable play surface protrudes from the bottom 220. The bottom 220 may include a slot 575 or other opening that permits the extendable play surface to move into and out of the cavity 221. In one embodiment, one or more of the extendable play surfaces is linked to the movable panel 560 such that rotation of the movable panel causes one or more of the extendable play surfaces to extend. For example, in FIG. 7, the extendable play surface 574 is in a retracted state and movable panel 560 is in a first orientation with the external surface 563 facing upward and the additional play structures 561 and 562 on the side opposite external surface 563 are obscured within cavity 221. In FIG. 8, the extendable play surface 574 is in a partially extended state and movable panel 560 is partially rotated. In FIG. 9, the extendable play surface 574 is in a fully extended state and movable panel 560 is in a second orientation with the additional play structures 561 and 562 facing upward and the external surface 563 on the side opposite additional play structures 561 and 562 is obscured within cavity 221. As shown in FIG. 5, the cavity 221 houses a slide 576 having a guide 577. The slide may be connected to one or more of the extendable play surfaces. Movable panel 560 includes a link, such as a bar, 564. The link 564 connects the movable panel 560 to the slide 576 by engaging with guide 577. As the movable panel 560 is rotated, the link forces the guide and in turn the slide to move within the cavity and thereby cause the extendable play surface 574 to either extend out of or retract into the cavity, depending on the direction the moveable panel is rotated. In alternate embodiments, an alternative linkage may be utilized, such as a gear attached to the movable panel that engages with a gear attached to a slide so as to translate the rotational motion of the movable panel 560 into lateral movement of the one or more extendable play surfaces. In one embodiment, a reciprocating gear system is attached to the extendable play surfaces such that as the movable panel is moved 180-degrees from a first position to a second position, the extendable play surfaces extend, and as the movable panel is moved from 180-degrees to 360-degrees (i.e. continued rotation from the second position to the first position) the extendable play surfaces retract.

As shown in FIG. 9, the extendable play surfaces 537, 574 are separated from the terminal edge 222 of the bottom (and in turn the surface on which the terminal edge rests, such as a table) by distances of $x_1$ and $x_2$, respectively. In some embodiments, such as embodiments A and B shown in FIG. 10, $x_1=x_2$. That way, extendable paly surface 574 of embodiment A mates with extendable play surface 573 of embodiment B and both embodiments may be adjoined to create an extended paly environment. In one embodiment, the edges of the extendable paly surfaces include connectors (such as mechanical or magnetic connectors) that connect extendable play surface of 574 of embodiment A with extendable play surface 573 of embodiment B.

Figure 6:
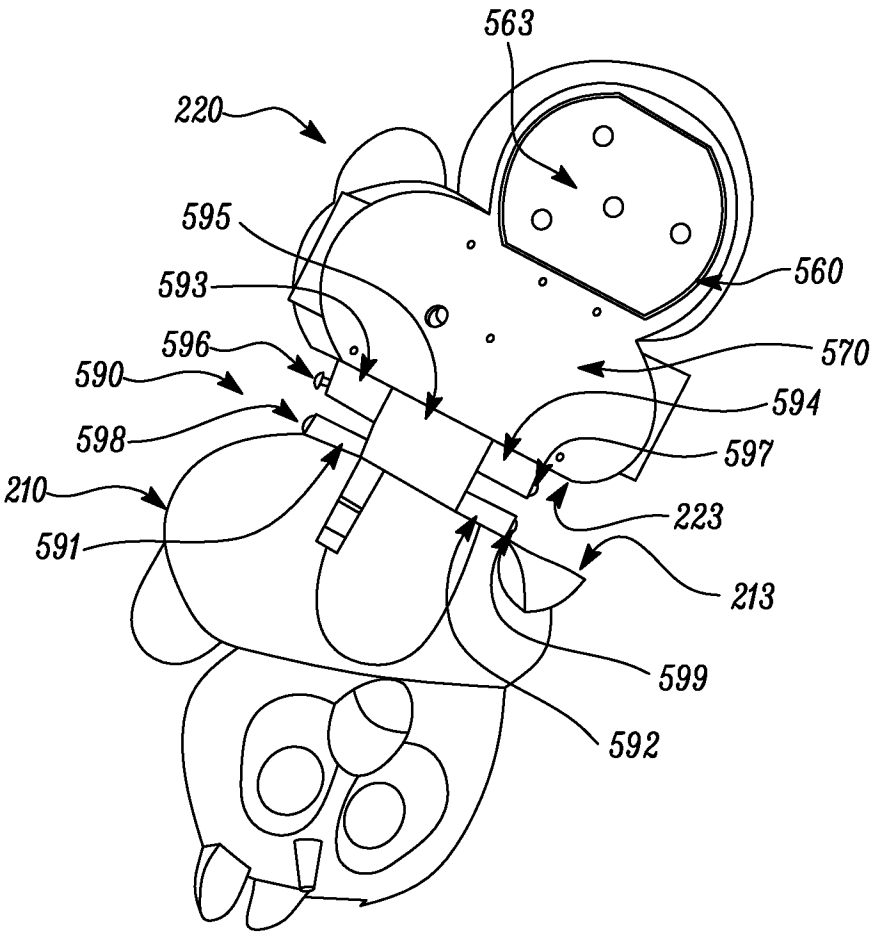
FIG. 6 is a perspective view of an embodiment of the present toy and play system in a partially open configuration and depicting the external portions of the toy and play system.

As shown in FIG. 6, top 210 and bottom 220 are connected by linkage 590. In the embodiment of FIG. 6, the linkage is a 270-degree hinge, however, alternate embodiments may exhibit alternative linkages. For the embodiment of FIG. 6, the top 210 includes protuberances 591 and 592 extending from top base 213, and the bottom 220 includes protuberances 593 and 594 extending from bottom base 223. The linkage 590 further includes a link 595. Protuberances 593 and 594 are connected to link 595 by pins 596 and 597, respectively, and protuberances 591 and 592 are connected to link 595 by pins 598 and 599, respectively. In an alternative embodiment, a single pin may extend from protuberance 593 through link 595 and connect with protuberance 594. Protuberances 591, 592 and link 595 may be similarly connected. The linkage allows for the top and bottom to fold together such that their respective terminal edges mate, as shown generally in FIG. 4, and unfold such that the top base 213 folds over bottom play surface 570 and mates with bottom play surface 570 as shown in FIG. 9 (or 270 as shown in FIG. 2). As shown in FIGS. 2 and 9, the top 210 may be moved to a vertical orientation such that it overlaps bottom paly surface 270, 570, respectively.

In some embodiments, the top 210 and bottom play surface 570 may include a connector such that, when the top is moved into a vertical orientation over the play surface, the connector engages to link the top and bottom together. With reference to FIGS. 7-9, in one embodiment, the bottom play surface 570 includes a detent (such as a hole) 571, while the top includes a pin 572 that is adapted to fit within the detent and be retained by the detent. In FIGS. 7 and 8, the pin 572 and detent 571 are disengaged. In FIG. 9, the pin and detent are engaged and the top base 213 is held proximal and linked to the bottom play surface 570 by the engaged connector. In some embodiments, the pin may be connected directly to the top base. In the embodiment of FIGS. 7-9, the pin is an extension of a hinge 243. In one embodiment, the pin 572 frictionally engages detent 571. In another embodiment, as shown in FIG. 7, the pin exhibits a flared shape such that the flared edge of the pin engages the thickness of the play surface defining detent 571. In another embodiment, the pin and detent may be replaced with magnets such that the connector is formed of a first magnet mounted within the top 210 and a second magnet mounted within the bottom such that when the top is in a substantially vertical orientation and substantially perpendicular to the play surface, the two magnets sufficiently align to form a magnetic coupling.

The embodiments may provide multiple play arrangements. For example, one method of play for the present toy and system includes transporting embodiment A in a closed orientation where terminal edge 222 is mated with terminal edge 212. The toy may then be opened and top portion may be aligned in a vertical orientation such that the top base 213 mates with play surface 270. Embodiment A may further be altered for additional play through manipulating movable panel 260 between a first orientation and a second orientation where the second orientation exposes one or more play structures such as 261 or 262. Embodiment A may also be manipulated to extend one or more extendable play surfaces. Figures, such as figurines 1001, 1002 or vehicles (not shown), may be added and supported by one or more of the extendable play surfaces 574, 573, bottom play surface 570, play structures 261, 262, and top play surfaces 281, 282. Another Embodiment A or an alternative Embodiment B may then be aligned with the first Embodiment A so as to mate the extendable play surfaces of each and create an extended play environment.

Although the present device and system has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

What is claimed is:

1. A toy comprising:

a top formed of a top shell including a top base, the top shell terminating at a top terminal edge such that the top terminal edge and the top shell define a top cavity, a bottom formed of a bottom shell terminating at a bottom terminal edge such that the bottom terminal edge and the bottom shell define a bottom cavity;

the bottom shell includes a movable bottom panel comprising a first side and a second side opposite the first side;

wherein the moveable bottom panel is adapted to rotate about an axis that is parallel to a plane defined by the bottom terminal edge such that when the movable bottom panel is in a first position, the second side is housed within the bottom cavity and the first side is not within the bottom cavity and such that when the movable bottom panel is in a second position, the first side is housed within the bottom cavity and the second side is not within the bottom cavity; and wherein the top and bottom are connected by a linkage.

2. A toy as in claim 1, further comprising plurality of movable segments associated with the top.

3. A toy as in claim 1, wherein the movable bottom panel includes a first side that defines a portion of an exterior of the bottom shell when the top terminal edge and bottom terminal edge are brought proximal to one another.

4. A toy as in claim 1, wherein a majority of the first side forms a generally flat surface.

5. A toy as in claim 4 wherein the second side includes one or more play structures.

6. A toy as in claim 1, further comprising one or more extendable play surfaces wherein one or more of the extendable play surfaces is connected to the movable bottom panel such that an alteration in the rotational orientation of the movable panel causes an alteration in the translational orientation of one or more of the connected extendable play surfaces.

7. A toy comprising:

a top formed of a top shell including a top base, the top shell terminating at a top terminal edge such that the top terminal edge and the top shell define a top cavity, a bottom formed of a bottom shell terminating at a bottom terminal edge such that the bottom terminal edge and the bottom shell define a bottom cavity;

wherein the bottom shell includes a movable bottom panel that has a first side and a second side, where the first side forms an exterior surface of bottom shell and that is opposite the bottom terminal edge; and wherein the top and bottom are connected by a linkage such that the top terminal edge is adapted to mate with the bottom terminal edge and rotate to an orientation that is over 180 degrees from a plane defined by the bottom terminal edge.

8. A toy as in claim 7, wherein the wherein the top and bottom are connected by a linkage such that the top terminal edge is adapted to rotate such that the top base is aligned with the movable bottom panel when the movable bottom panel forms an exterior surface of the bottom shell.

9. A toy as in claim 8, wherein the movable panel comprises a first side and a second side opposite the first side wherein a majority of the first side forms a generally flat surface.

10. A toy as in claim 7 wherein the second side includes one or more play structures.

11. A toy as in claim 7, wherein the movable bottom panel is connected to the bottom such that it moves from a first position, where the first side is exposed to the exterior of the bottom, to a second position, where the first side is housed within the cavity.

12. A toy as in claim 7, further comprising one or more extendable play surfaces wherein one or more of the extendable play surfaces is connected to the movable bottom panel such that an alteration in the rotational orientation of the movable bottom panel causes an alteration in the translational orientation of one or more of the connected extendable play surfaces.

* * * * *